US010476166B2

(12) United States Patent
Tuau et al.

(10) Patent No.: US 10,476,166 B2
(45) Date of Patent: Nov. 12, 2019

(54) DUAL-REFLECTOR MICROWAVE ANTENNA

(71) Applicant: Nokia Shanghai Bell Co. Ltd., Shanghai (CN)

(72) Inventors: Denis Tuau, Trignac (FR); Armel Lebayon, Trignac (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 15/739,023

(22) PCT Filed: Jun. 21, 2016

(86) PCT No.: PCT/IB2016/053676

§ 371 (c)(1),
(2) Date: Dec. 21, 2017

(87) PCT Pub. No.: WO2016/207787

PCT Pub. Date: Dec. 29, 2016

(65) Prior Publication Data

US 2018/0175510 A1 Jun. 21, 2018

(30) Foreign Application Priority Data

Jun. 23, 2015 (EP) ..... 15305967

(51) Int. Cl.
*H01Q 13/00* (2006.01)
*H01Q 19/19* (2006.01)
(Continued)

(52) U.S. Cl.
CPC ..... *H01Q 19/193* (2013.01); *H01Q 15/08* (2013.01); *H01Q 19/08* (2013.01); *H01Q 13/02* (2013.01)

(58) Field of Classification Search
CPC ..... H01Q 15/05; H01Q 19/08; H01Q 19/193; H01Q 15/08
See application file for complete search history.

(56) References Cited

U.S. PATENT DOCUMENTS 6,020,859 A 2/2000 Kildal
6,137,449 A * 10/2000 Kildal ..... H01Q 1/42 343/781 CA
(Continued)

FOREIGN PATENT DOCUMENTS

CN 101488606 A 7/2009
CN 103066391 A 4/2013
(Continued)

OTHER PUBLICATIONS

International Search Report for PCT/IB2016/053676 dated Oct. 13, 2016.

*Primary Examiner* — Dieu Hien T Duong
(74) *Attorney, Agent, or Firm* — Fay Sharpe LLP

(57) ABSTRACT

A dual-reflector antenna comprises a main reflector traversed by a feed source and a sub-reflector. The sub-reflector comprises a dielectric body extending between a first end that is small in diameter and a second end that is greater in diameter, the small-diameter end being connected to the end of the feed source constituted by a metal tube filled with a dielectric material. The end of the feed source connected to the sub-reflector comprises a housing, having an inner depth and inner diameter, built into the dielectric material. The small-diameter end of the sub-reflector comprises an inner portion having a substantially cylindrical shape, able to fit into the housing, having an outer length and outer diameter. The outer length and outer diameter of the small-diameter end of the sub-reflector are respectively less than the inner depth and inner diameter of the feed source, so as to form a space between the inner portion of the sub-reflector and the dielectric wall of the housing.

5 Claims, 4 Drawing Sheets

Figure 1:
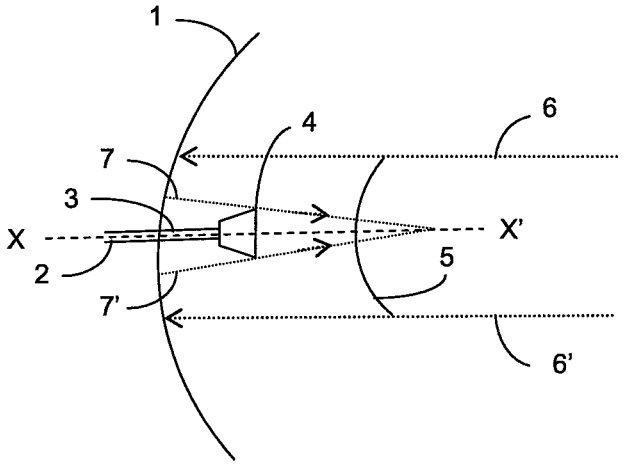

(51) Int. Cl.

| | |
|---|---|
| ***H01Q 15/08*** | (2006.01) |
| ***H01Q 19/08*** | (2006.01) |
| *H01Q 13/02* | (2006.01) |

(56) References Cited

U.S. PATENT DOCUMENTS

| | | | |
|---|---|---|---|
| 6,724,349 | B1 | 4/2004 | Baird et al. |
| 8,102,324 | B2 | 1/2012 | Tuau et al. |
| 8,890,759 | B2 | 11/2014 | Pantea et al. |
| 2013/0057444 | A1 | 3/2013 | Brandau et al. |

FOREIGN PATENT DOCUMENTS

| | | | | |
|---|---|---|---|---|
| CN | 103782447 | A | 5/2014 | |
| DE | 4200755 | A1 | 7/1993 | |
| WO | WO-2013113701 | A1 * | 8/2013 | ..... H01Q 19/026 |

* cited by examiner

DUAL-REFLECTOR MICROWAVE ANTENNA

FIELD

The present invention relates to a dual-reflector antenna, particularly of the microwave type, commonly used for mobile telecommunications networks.

BACKGROUND

The spectrum will increasingly become a scarce resource for point-to-point deployment connections, and many frequencies are currently saturated in dense urban areas. The very strict ETSI class 4 standard makes it possible to deploy more links in a given spectrum and to increase the ability to transport data with less interference.

In order to create compact antenna systems, dual-reflector antennas are used, particularly so-called "Cassegrain" antennas. The dual reflector includes a concave main reflector, most commonly a parabola or portion of a parabola, and a convex sub-reflector, much smaller in diameter, placed in the vicinity of the focus of the parabola on the same revolution axis as the main reflector. A feed source is located along the antenna's axis of symmetry, facing the sub-reflector. These antennas are called "deep-dish" antennas, with a low f/D ratio, less than or equal to 0.25, where f is the focal distance of the main reflector (distance between the apex of the reflector and its focus) and D is the diameter of the main reflector.

In order to meet the criteria of the ETSI class 4 standard, an antenna requires a high radio frequency. The main challenge is to obtain an antenna pattern with a very low level of secondary lobes, in particular for an antenna with a $D/\lambda$ ratio (D: Diameter of the main reflector and $\lambda$: wavelength of the central frequency in the antenna's working frequency band) of less than 30. In that frequency range, the masking effect of the sub-reflector increases the secondary lobes.

These antennas exhibit spillover losses that are high and reduce the front-to-back ratio of the antenna. These spillover losses lead to the environment being polluted by RF waves. The spillover losses must therefore be limited to very low levels, as required by the ETSI class 4 standard.

SUMMARY

In order to reduce the first sidelobes of the radiation pattern (mask effect), one solution is to minimize the obstruction of the sub-reflector by using a sub-reflector that is small in size. However, this solution is very difficult to implement, because a sub-reflector that is small in diameter reduces the spillover performance and return loss if the distance d that separates it from the feed horn is too short.

One common solution for eliminating the spillover effect is to attach a shroud to the periphery of the main reflector, cylindrical in shape, with a diameter close to that of the main reflector and sufficient in height, coated on the interior with a layer that absorbs RF radiation. However, this solution is expensive and the resulting antenna is bulky. It is therefore necessary to find a solution in order to obtain a high value for the front-to-back ratio, with an absorbing shroud of acceptable length. For example, the height of the absorbing shroud must preferably be less than half the diameter D of the main reflector.

With this purpose, a dual-reflector antenna is proposed whose radiation pattern is improved in order to meet the criteria of the ETSI class 4 standard, without exhibiting the drawbacks of earlier solutions.

To that end, the purpose of the present invention is a dual-reflector antenna comprising a main reflector traversed by a feed source and a sub-reflector, the sub-reflector comprising a dielectric body extending between a first end that is small in diameter and a second end that is greater in diameter, the small-diameter end being connected to the end of the feed source constituted by a metal tube filled with a dielectric material. The end of the feed source connected to the sub-reflector comprises a housing, having an inner depth and inner diameter, which is built into the dielectric material, and the small-diameter end of the sub-reflector comprises an internal portion having a substantially cylindrical shape, able to fit into the housing, having an outer length and outer diameter. The outer length and outer diameter of the small-diameter end of the sub-reflector are respectively less than the inner depth and inner diameter of the feed source, so as to form a space between the inner portion of the sub-reflector and the dielectric wall of the housing.

Preferably, this space is filled with air. The air is trapped between the small-diameter and of the sub-reflector and the feed source at the time when those two parts are brought into contact during assembly.

According to one aspect, the dimensions of the cylindrical shape of the small-diameter and of the sub-reflector are on the order of $\lambda/8 \times \lambda/10$, where $\lambda$ is the wavelength of the central frequency of the antenna's working frequency band.

According to another aspect, the housing at the end of the feed source has a substantially cylindrical shape. In this case, the dimensions of the housing are on the order of a quarter-wave $\lambda/4$.

A benefit of the present invention is achieving high levels of radio performance enabling it to meet the criteria of the ETSI class 4 standard, without exhibiting prohibitive bulkiness.

The invention applies to microwave antennas, particularly to microwave antennas in which the diameter of the main reflector is between 1 foot and 2 feet.

BRIEF DESCRIPTION

Figure 2:
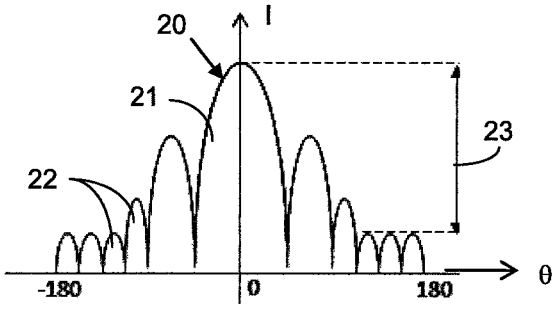
Figure 3:
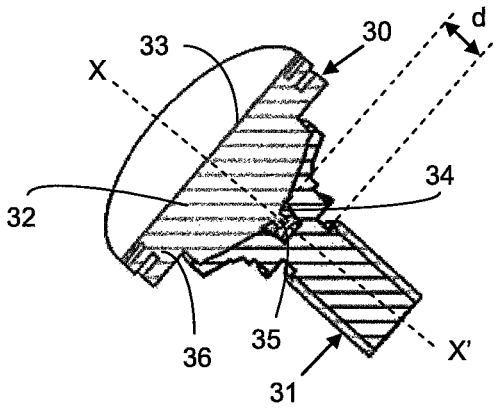
Figure 4:
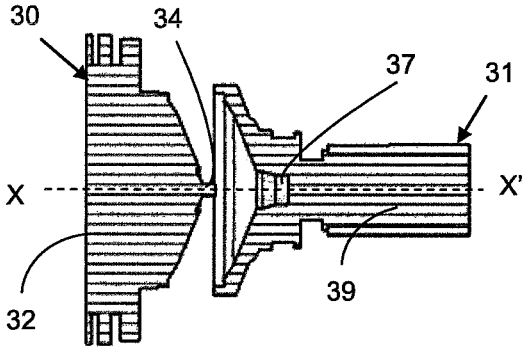
Figure 5:
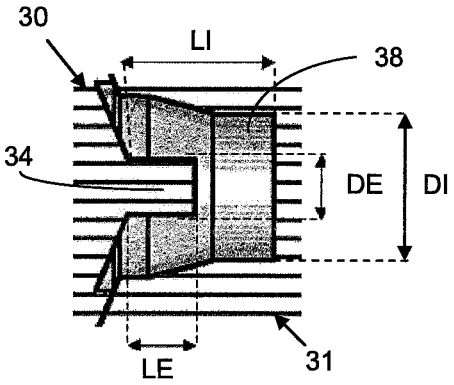
Figure 6:
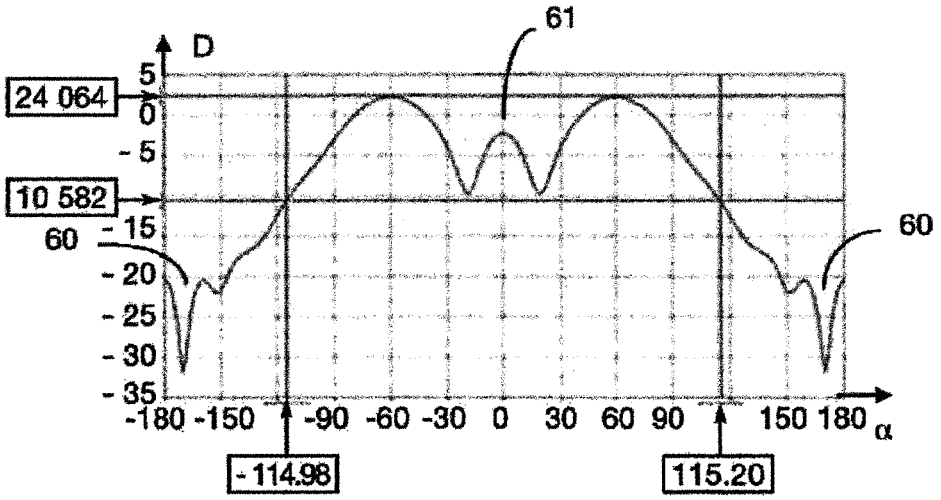
Figure 7:
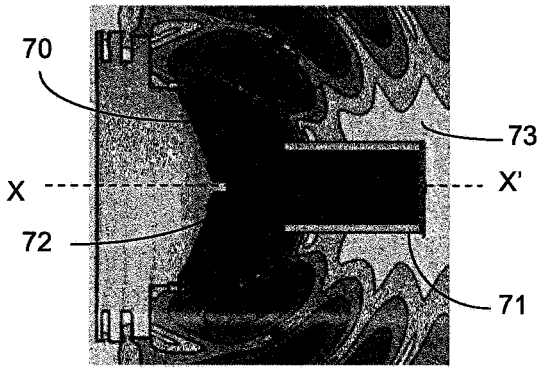
Figure 8:
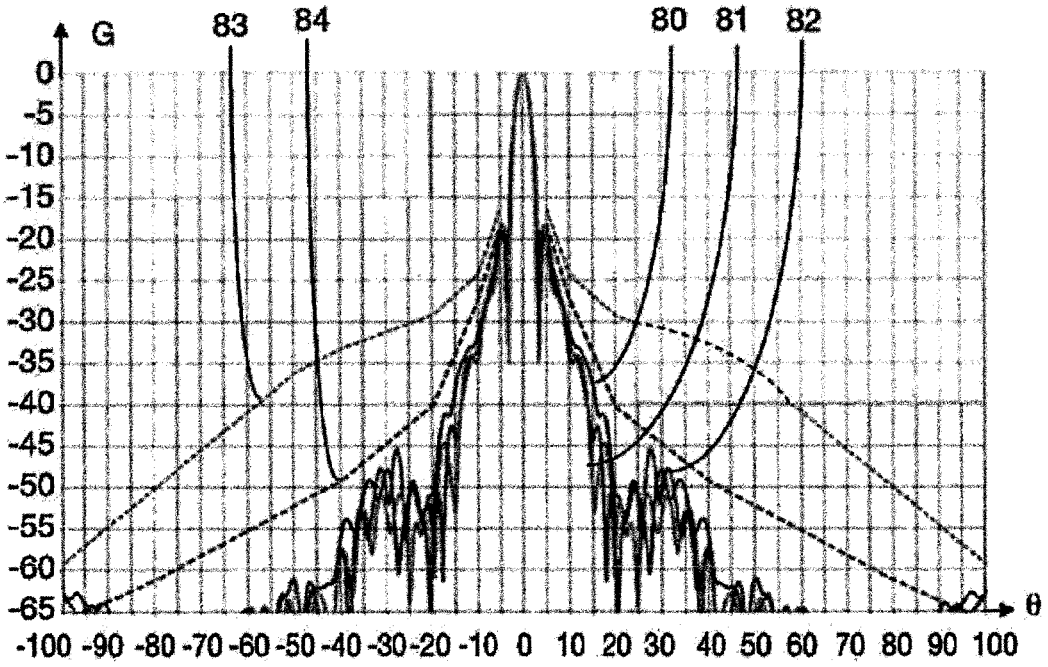
Figure 9:
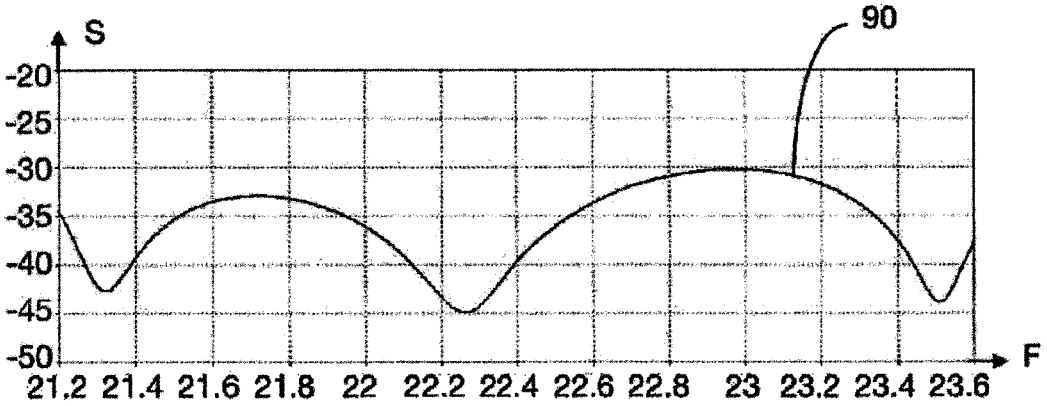

Other characteristics and advantages will become apparent on reading the following description of one construction, given naturally as an illustrative and non-limiting example, and in the attached drawing in which FIG. 1 schematically depicts a radiation path emitted in a dual-reflector antenna, FIG. 2 is a simplified diagram of the radiation pattern of a directive antenna in the horizontal plane based on the transmission/reception angle, FIG. 3 depicts a cross-section of the sub-reflector coupled to the waveguide, FIG. 4 depicts an exploded cross-section of the sub-reflector coupled to the waveguide, FIG. 5 depicts an exploded cross-section of the area where the sub-reflector is coupled to the waveguide, FIG. 6 depicts the radiation pattern of the antenna's sub-reflector showing low spillover losses FIG. 7 depicts the behaviour of the electrical field E around the area where the sub-reflector is coupled to the waveguide, FIG. 8 depicts the radiation pattern of the antenna's main reflector showing the low field strength of the sidelobes and a high front-to-back ratio, FIG. 9 depicts the return loss of the feed source.

DETAILED DESCRIPTION

FIG. 1 has schematically depicted an antenna having symmetry of revolution around an axis X-X'. The antenna comprises a main reflector 1 having a concavity, having for example the shape of a paraboloid revolving around the axis X-X' in such a way as to present a marked directivity in the direction of the axis X-X'. A feed source 2 of the antenna is located along the axis X-X' at the centre of the part of the main reflector 1 that has the concavity. The feed source 2, like the antenna as a whole, exhibits a symmetry of revolution around the axis X-X'. The feed source 2 here is a waveguide formed of a metal tube, for example one made of aluminium, filled with a dielectric material. In other cases, the feed source may be a coaxial cable connected to a feed horn. The feed source 2 comprises, along the axis X-X', a portion of the waveguide 3 of which a first end traverses the centre of the main reflector 1. A second end 4 of the waveguide 3 is located facing a sub-reflector 5. The sub-reflector 5, intersecting the axis X-X', has a shape of revolution around the axis X-X'. The sub-reflector 5 exhibits an outer convexity that faces the concavity of the main reflector 1. The outer diameter of the sub-reflector 5 is greater than the diameter of the end 4 of the waveguide 3 that faces it.

During reception, the radiation is received by the main reflector 1, but a portion of that radiation is masked by the sub-reflector 2 which helps increase the sidelobes. The zone masked by the sub-reflector 2 is bounded by the lines 6 and 6' in FIG. 1. The main reflector 1 reflects the radiation that it gets from the sub-reflector 5. A portion of the reflected radiation is then masked by the feed source 2. The zone masked by the feed source 2 is bounded by the lines 7 and 7' in FIG. 1.

During transmission, the antenna's feed source 2 emits incident radiation in the direction of the sub-reflector 5 that is reflected to the main reflector 1. A portion of the incident radiation is sent back in a divergent direction, causing spillover losses.

The curve 20 in FIG. 2 schematically depicts the radiation pattern in the horizontal plane of the main reflector of a directive antenna. The field strength I of the radiation is given on the y-axis relative to the transmission/reception angle$\theta$ in degrees given on the x-axis. The central area corresponds to the main lobe 20 and the side areas correspond to the secondary lobes 21. The difference in field strength between the main lobe 20 and the secondary lobes 21 defines the antenna's front-to-back ratio 23, which is very high in this case.

We shall now consider FIGS. 3, 4 and 5, which depict one embodiment of a dual-reflector antenna.

In a reception mode, the sub-reflector 30 reflects the electromagnetic waves coming from the main reflector to the waveguide 31. In a transmission mode, the sub-reflector 30 reflects the electromagnetic waves coming from the waveguide 31 to the main reflector. The sub-reflector 30 comprises a dielectric body 32 extending between a first end 33 and a second end 34. Due to the difference in dimensions between the diameter of the sub-reflector 30 and the diameter of the waveguide 31, the outer surface of the dielectric body 32 has a frustoconical shape having two ends, one being small-diameter and the other large-diameter. The small-diameter end 34 is connected to the waveguide 31. The small diameter is substantially equal to the diameter of the waveguide 31, and the large diameter is substantially equal to the outer diameter of the sub-reflector 30. In the event that the body 32 is formed of a dialectric material, a metal deposit created on the outer surface of the dielectric body 32 constitutes the reflective surface of the sub-reflector 30.

In order to contain the electromagnetic waves between the waveguide 31 and the sub-reflector 30, the second end 34 of the sub-reflector 30 is adapted to couple to the end of the waveguide 31. The containment of the electromagnetic waves between the waveguide 31 and the second end 34 of the sub-reflector 30 ensures better electromagnetic coupling between the sub-reflector 30 and the main reflector. The dielectric body 32 comprises an internal portion 35 penetrating into the waveguide 31 and an external portion 36 outside the waveguide 31.

The end 34 of the internal portion 35 of the sub-reflector 30 has a substantially cylindrical shape whose outer length LE and outer diameter DE are less than the inner depth LI and inner diameter DI of a housing 37 built into the dielectric material 39 at the end of the waveguide 31 into which the end 34 of the internal portion 35 of the sub-reflector 30 fits. The dimensions of that cylinder are on the order of $\lambda/8\times\lambda/10$, where $\lambda$ is the wavelength of the central frequency of the antenna's working frequency band.

Thus, a space 38 is formed between the end 34 of the internal portion 35 of the sub-reflector 30 and the housing walls 37 built into the dielectric material 39 at the end of the waveguide 31. This space 38 traps air when the waveguide 31 is being assembled with the end 34 of the internal portion 35 of the sub-reflector 30. The shape of this space 38 is close to a cylinder, with dimensions around the quarter-wave 214. Preferably and for the sake of convenience, the space 38 contains air, but it may contain another gas or another material with a suitable dielectric constant. The presence of that air volume increases the performance in terms of the bandwidth due to a lower dielectric constant compared to the dielectric material that forms the dielectric body 32 of the sub-reflector 30.

Generally, the material used for the dielectric body 32 is a material of a polystyrene type that has a dielectric constant value around 2.55, which is metallized onto its outer surface. However, the body 32 might just as well be made of metal. The dielectric material 39 that fills the waveguide 31 preferably has a dielectric constant of between 2 and 3.5. Out of convenience, it is possible to use the same dielectric material 32, namely a polystyrene material with a dielectric constant value around 2.55.

The distance d separating the end 34 of the sub-reflector 30 from the end of the waveguide 31 may be slightly reduced while keeping the same level of return loss. Thus, the radiation pattern is improved with a lower field strength in the sidelobes. Another benefit of that air volume 38 is to facilitate the process of adhering the sub-reflector 30 onto the dielectric walls of the waveguide 31 while avoiding bubbles in the adhesive.

In the radiation pattern of the sub-reflector in the horizontal plane, depicted in FIG. 6, the gain or directivity D in dB is given on the y-axis compared to the angle of reflection $\alpha$ in degrees given in the y-axis. The angle of reflection $\alpha$ is the angle between the axis of the main reflector's parabola and the line that meets a point on that parabola at the focal point of the parabola. The radiation pattern of a deep-dish antenna (f/D ratio on the order of 0.17) shows a good level of radio performance in terms of spillover loss. Spillover losses 60 above +/−115°, i.e. outside the main reflector, are fairly low. In the central part 61 of the radiation pattern, the field strength is intentionally reduced by about ten dB to minimize the mask effect of the feed source. A low field strength radiated in the centre of the parabola reduces the reflections within the feed source.

FIG. 7 depicts the representation of the map of field E around the junction between the sub-reflector 70 and the waveguide 71. This is the representation of the maximum amplitude of the electric field E at a given moment. An area with a stronger field 72 is around the end of the sub-reflector 70 and an area with a weaker field 73 are found along the waveguide 71 on the side opposite the sub-reflector 70, which shows a weak field radiated towards the centre of the parabola of the main reflector.

FIG. 8 depicts the measurement of the normalized antenna's gain relative to the maximum gain. Depicted is the main reflector's radiation pattern in the horizontal plan of an antenna with a leg whose diameter depends on the angle of transmission/reception θ, respectively at a frequency of 21.2 GHz, 23.6 GHz and 22.4 GHz (curves 80, 81 and 82). The gain G in dB is given in the y-axis, and in the x-axis the angle of transmission/reception θ in degrees. The curves 80, 81 and 82 show radiated values with small secondary lobes, below the ETSI class 3 (curve 83) and ETSI class 4 (curve 84) standards.

As depicted in FIG. 9, the return loss performance is greatly improved, with a return loss −30 dB less. The parameter S in dB is given on the y-axis, and the frequency F in GHz is given on the x-axis.

This invention is naturally not limited to the fabrication methods described, and is open to numerous variants available to professionals in the field without departing from the spirit of the invention. In particular, it is possible to alter the shape and dimensions of the housing, as well as the nature and quantity of the material filling the space.

The invention claimed is:

1. A dual-reflector antenna comprising a main reflector traversed by a feed source and a sub-reflector, the sub-reflector comprising a dielectric body extending between a first end that is small in diameter and a second end that is greater in diameter, the small-diameter end being connected to the end of the feed source constituted by a metal tube filled with a dielectric material, wherein:

the end of the feed source connected to the sub-reflector comprises a housing having an inner depth and inner diameter, built into the dielectric material, the small-diameter end of the sub-reflector comprises an inner portion having a substantially cylindrical shape, able to fit into the housing, having an outer length and outer diameter, the outer length and outer diameter of the small-diameter end of the sub-reflector are respectively less than the inner depth and inner diameter of the housing, so as to form a space between the inner portion of the sub-reflector and the dielectric wall of the housing.

2. An antenna according to claim 1, wherein the space is filled with air.

3. An antenna according to claim 1, wherein the dimensions of the cylindrical shape of the small-diameter end of the sub-reflector are on the order of $\lambda/8 \times \lambda/10$.

4. An antenna according to claim 1, wherein the housing has a substantially cylindrical shape.

5. An antenna according to claim 4, wherein the dimensions of the housing are on the order of a quarter-wave $\lambda/4$.

* * * * *